US005379780A

United States Patent [19]

Uematsu et al.

[11] Patent Number: 5,379,780

[45] Date of Patent: Jan. 10, 1995

[54] METHOD AND SYSTEM FOR EXPANDING TOBACCO

[75] Inventors: Hiromi Uematsu; Masanori Wakui; Toshio Iden; Toshio Takahashi; Kensuke Uchiyama, all of Hiratsuka, Japan

[73] Assignee: Japan Tobacco Inc., Tokyo, Japan

[21] Appl. No.: 788,356

[22] Filed: Nov. 6, 1991

[30] Foreign Application Priority Data

Nov. 7, 1990 [JP] Japan ..... 2-299872

[51] Int. Cl.[6] ..... A24B 3/18

[52] U.S. Cl. ..... 131/291; 131/296

[58] Field of Search ..... 131/291, 296, 900–902

[56] References Cited

U.S. PATENT DOCUMENTS

| | | | |
|---|---|---|---|
| 3,409,027 | 11/1968 | Zygmunt | 131/291 |
| 4,258,729 | 3/1981 | de la Burde et al. . | |
| 4,333,483 | 6/1982 | de la Burde et al. . | |
| 4,366,825 | 1/1983 | Utsch et al. . | |
| 4,494,556 | 1/1985 | Wu et al. . | |
| 4,523,598 | 6/1985 | Weiss et al. . | |
| 4,844,101 | 7/1989 | Hirsch et al. . | |
| 5,020,550 | 6/1991 | Uchiyama et al. | 131/291 X |

FOREIGN PATENT DOCUMENTS

| | | |
|---|---|---|
| 0074059 | 8/1982 | European Pat. Off. . |
| 0285811 | 10/1988 | European Pat. Off. . |
| 0370489 | 11/1989 | European Pat. Off. . |
| 57-25149 | 6/1978 | Japan . |
| 57-25194 | 5/1982 | Japan . |
| 59-6875 | 6/1982 | Japan . |
| 9006695 | 12/1989 | WIPO . |

*Primary Examiner*—Jennifer Bahr

[57] ABSTRACT

Steam or high-temperature gas containing steam flows through a gas-flow drying pipe. Tobacco is fed from a feed port into the high-temperature gas flowing through the gas-flow drying pipe, and heated and expanded while it flows together with the gas. Steam or water is injected into the high-temperature gas flow from injection nozzles at the positions downstream from the feed port to change the gas temperature. Thereby, the heat quantity given to the tobacco from the high-temperature gas is controlled to prevent the tobacco quality from degrading.

16 Claims, 3 Drawing Sheets

METHOD AND SYSTEM FOR EXPANDING TOBACCO

BACKGROUND OF THE INVENTION

1. Field of the Invention

The present invention relates to a method and system for expanding tobacco made by shredding tobacco leaves with an expanding agent such as carbon dioxide, and heating, expanding, and drying the tobacco impregnated with the expanding agent.

More particularly, the present invention relates to a method and system for preventing the aroma of tobacco and the smoking taste from deteriorating in the following processes. The tobacco impregnated with the expanding agent is continuously fed into the flow of high-temperature gas containing stream, dispersed in the gas-flow, flown together with the gas, and heated while the tobacco flows together with the gas, and the expanding agent impregnated in the tobacco expands to expand the texture of the tobacco and the tobacco is dried while heated. Steam or water is externally injected to a channel where the gas and tobacco flow and the gas temperature is controlled to expand and dry the tobacco.

2. Description of the Related Art

Conventionally, tobacco is expanded to moderate the smoking taste and decrease the cost by decreasing the amount of tobacco used.

The material is expanded by impregnating the tobacco texture with an expanding agent such as freon or carbon dioxide before heating the tobacco to quickly expand the expanding agent impregnated in the tobacco and the tobacco texture.

Recently, however, carbon dioxide is used for the expanding agent in order to avoid affecting the environment. When the expanding agent uses carbon dioxide, it easily goes out of the tobacco. Therefore, it is necessary to quickly heat the tobacco impregnated with carbon dioxide and quickly swell the impregnated carbon dioxide and the tobacco texture.

To heat the tobacco impregnated with the expanding agent, a method is conventionally used to dry tobacco by applying hot air to it while it is carried by a net conveyor. Another method is also conventionally used at times for drying tobacco by applying hot air and infrared rays to it while it is carried by a net conveyor.

For the above methods, however, it is difficult to quickly heat tobacco and, in addition, the impregnated carbon dioxide is almost lost before the tobacco material is expanded because of a low heating speed when the expanding agent uses carbon dioxide.

There is still another tobacco drying method for feeding tobacco into the flow of high-temperature gas. For this method, the tobacco fed into the high-temperature gas is dispersed and flows together with the gas. Therefore, it is possible to quickly heat the tobacco with the high-temperature gas. The high-temperature gas uses, for example, a gas made by mixing air with 50 to 95 volume percent of superheated water vapor. Because the mixture gas consisting of air and superheated water vapor has a large specific heat, the tobacco fed into the gas-flow can more quickly be heated.

Therefore, when the expanding agent uses carbon dioxide, the method of feeding tobacco into the above high-temperature gas-flow is suitable for heating the tobacco impregnated with carbon dioxide.

For the method of feeding tobacco into the high-temperature gas-flow, however, there is the disadvantage that the tobacco fed into the high-temperature gas-flow is burnt and the aroma of the tobacco and the smoking taste are degraded because a large heat quantity is given to the tobacco from the high-temperature gas though the tobacco can quickly be heated.

When the expanding agent uses, for example, carbon dioxide, it is necessary to feed the tobacco into the gas-flow containing more than 50 volume percent of water vapor and having the temperature of 200° to 350° C. in order to adequately swell the tobacco impregnated with carbon dioxide. However, the texture of tobacco leaves is burnt when the temperature of tobacco exceeds 140° C., and the aroma and the smoking taste are degraded when the temperature of it exceeds 180° C. because the sugar contained in the tobacco leaves decomposes.

Therefore, when the agent uses carbon dioxide and the tobacco impregnated with the carbon dioxide is fed into high-temperature gas-flow to expand and dry tobacco, it is necessary to quickly contact the tobacco with the high-temperature gas so that the tobacco is adequately expanded and to prevent the aroma and the smoking taste from degrading. However, it is difficult to control contacting of the tobacco fed into the high-temperature gas-flow with the high-temperature gas and heating of the tobacco so that it meets the above conditions. To control heating of the tobacco fed into the high-temperature gas-flow, various methods and systems have been developed so far.

For example, the official gazette of Japanese Patent Laid-open No. S59-6875 discloses a method and system for feeding tobacco into high-temperature steam flow and installing a tangential separator at the down-stream side of the tobacco feed port. In this case, the tobacco fed from the feed port contacts high-temperature gas and flows together with the high-temperature gas, and it is separated from the high-temperature gas by the tangential separator. Therefore, it is possible to securely control the contacting time between the tobacco and the high-temperature gas and the heating state of the tobacco by controlling the distance between the tobacco feed port and the tangential separator and the gas-flow rate. The official gazette also discloses a method for feeding tobacco into the tangential separator to contact the tobacco with high-temperature gas only for a very short time before it is immediately separated from the gas.

The official gazette of Japanese Patent Publication No. S57-25194 discloses a technique for feeding tobacco into a pipe where high-temperature gas-flows and controlling the contacting time between the tobacco and the high-temperature gas at the range of 0.2 to 2.0 sec.

The technique for controlling the contacting time between tobacco and high-temperature gas is disclosed in these official gazettes. However, to adequately expand the tobacco and prevent the quality from degrading, reciprocal conditions must be met. Therefore, no adequate effect can be obtained only by controlling the contacting time between the tobacco and high-temperature gas as disclosed in these official gazettes.

How the aroma of the greatly-heated tobacco and its smoking taste are degraded is complex and delicate. For example, the tobacco fed into the superheated water vapor flow of 300° C. maintains the practically-satisfactory quality when the contacting time between the tobacco and high-temperature water vapor is 1.5 sec.

However, it does not maintain the practically-satisfactory quality for the contacting time of 1.6 sec. These characteristics are confirmed through the test executed by installing a separator at the down-stream side of a pipe where high-temperature gas-flows and changing side position where the tobacco is fed into the pipe and the time until the tobacco is separated from the high-temperature gas-flow after it is fed into the gas-flow.

Moreover, the expanded tobacco containing much water would shrink after it expands. Therefore, to prevent the expanded tobacco from shrinking, it is also clarified that the expanded tobacco should be brought under almost absolute dry condition with the water content of 2 to 3 weight percent.

In short, when the expanded agent uses carbon dioxide, it is necessary to feed the tobacco impregnated with carbon dioxide into high-temperature gas-flow and quickly heat it. In this case, however, it is necessary to control the contacting state between the tobacco and the gas, adequately expand the tobacco, and prevent its quality from degrading.

SUMMARY OF THE INVENTION

The present invention has the following features to improve the above conventional disadvantages.

The feature of the present invention is described below. That is, by injecting steam or water into the channel where the high-temperature gas and tobacco flow and controlling the gas temperature, the tobacco flowing together with the gas receives heat from the gas and the gas temperature is changed due to the injected steam or water during flowing.

Therefore, the heat quantity of the tobacco received from the gas changes while the tobacco flows together with the gas and the tobacco heating state can accurately and precisely be controlled. Thus, the tobacco can adequately be expanded, heated, and dried so that the aroma and the smoking taste are not degraded.

The system for executing the method of the present invention has a gas-flow drying pipe where the high-temperature gas-flows and a feed port for feeding the tobacco impregnated with a expanded agent into the high-temperature gas-flow passing through the gas-flow drying pipe. Moreover, it preferably has a plurality of injection nozzles at the specified positions downstream from the feed port. Steam or water is injected into the high-temperature gas-flow from the nozzles to control the gas temperature.

Though the method and system of the present invention are suitable for use of carbon dioxide as an expanding agent, the expanding agent can use substances other than carbon dioxide.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
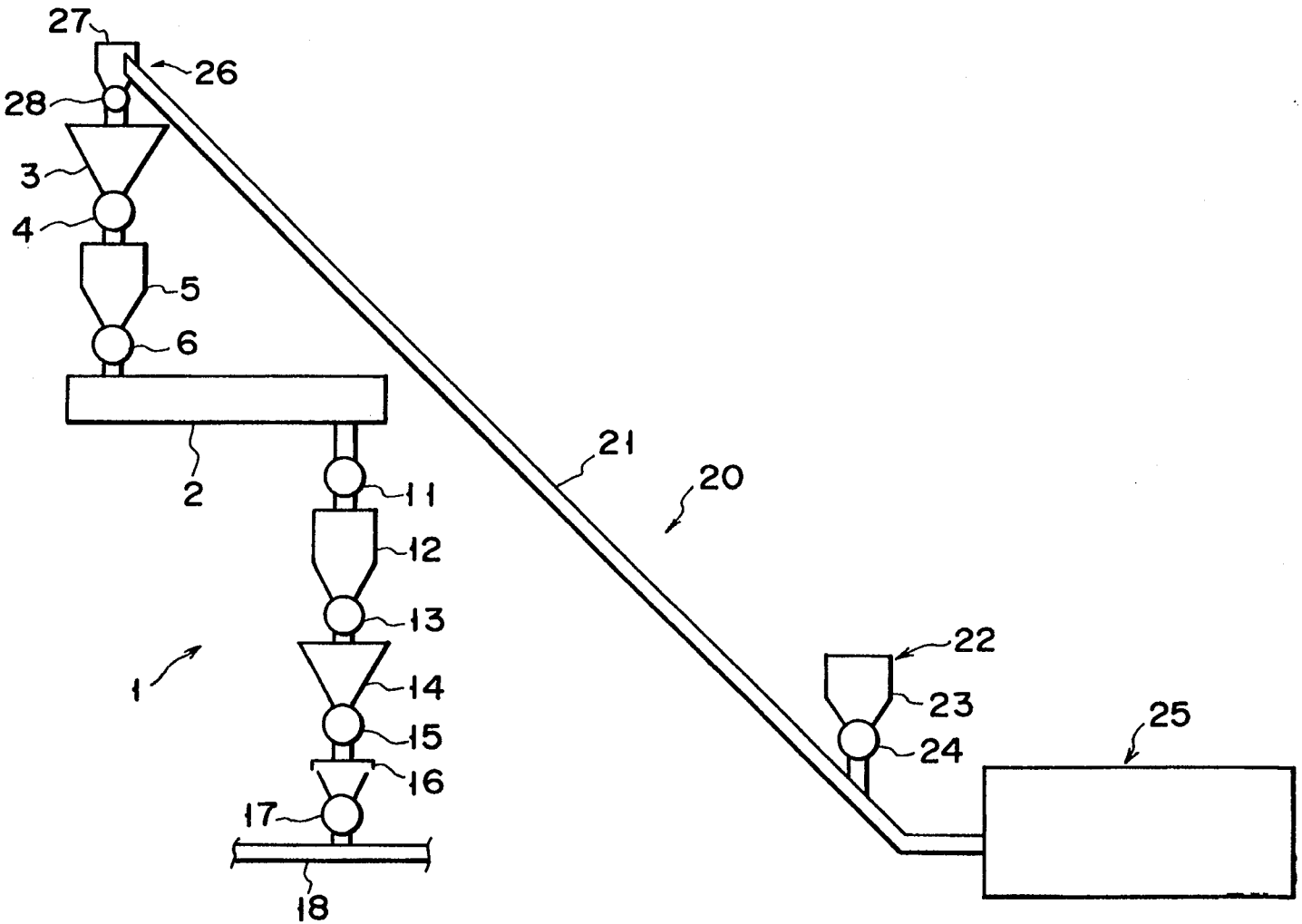
FIG. 1 shows a schematic drawing of the whole tobacco expanding system of the present invention.

The following is the description of the method and system of the present invention according to the embodiment shown in the drawings. The embodiment has a gas-flow drying system for heating and expanding the tobacco impregnated with an expanding agent such as carbon dioxide.

The following is the outline of the entire tobacco expanding system according to FIG. 1.

In FIG. 1, numeral 1 is the major section of the system and numeral 2 is an impregnator which consists of a high-pressure container and a screw feeder installed in it. The inside of the impregnator 2 is kept at the atmosphere of 30 kg/cm$^2$ at $-5°$ C. and filled with carbon dioxide. Tobacco is fed into a feed section, for example, the first chute 3 at the top of the system and sent to the impregnator 2 through the first rotary feeder 4, second chute 5, and second rotary feeder 6. Then, the tobacco is pressured up to 30 kg/cm$^2$ when it passes through the rotary feeders 4 and 6.

Then, the tobacco is impregnated with carbon dioxide while it is sent through the impregnator 2. The tobacco impregnated with carbon dioxide is sent to an exhaust chute 16 through the third rotary feeder 11, third chute 12, fourth rotary feeder 13, fourth chute 14, and rotary valve 15. The tobacco is depressurized to the atmospheric pressure when it passes through the rotary feeders 11 and 13.

Then, the tobacco is sent to a gas-flow drying pipe 18 through a rotary valve 17 from the exhaust chute 16. Because steam of, for example, 200° to 350° C. flows through the gas-flow drying pipe 18, the sent tobacco is heated in a short time. Therefore, the carbon dioxide contained in the tobacco is expanded because it is depressurized and heated and the texture of the tobacco leaves is expanded to be provided with the expanding treatment. The steam entering the exhaust chute 16 is exhausted from the exhaust chute 16. Therefore, the steam is prevented from entering the expanding treatment system.

A carrying system 20 for carrying tobacco is installed at the feed section of the expanding system, that is, at the first chute 3.

The carrying system 20 has an air duct 21 whose one end is set to the tobacco feed position and whose other end is set to the feed section of the system, that is, the first chute 3.

A feed system 22 is connected to the one end of the air duct 21. The feed system 22 has a feed hopper 23 and air lock 24 and the tobacco in the feed hopper 23 is fed to the one end of the air duct 21 through the air lock 24.

Moreover, a blowing system 25 is connected to the one end of the air duct 21. The blowing system 25 feeds air for carrying tobacco to the air duct. The tobacco fed from the feed system 22 is carried through the air duct by the air sent from the blowing system 25.

A separation system 26 is connected to the other end of the air duct 21. The separation system 26 has a tangential separator 27 and air lock 28, which separates the tobacco from the carrying air and feeds it to the first chute 3 through the air lock 28.

Figure 2:
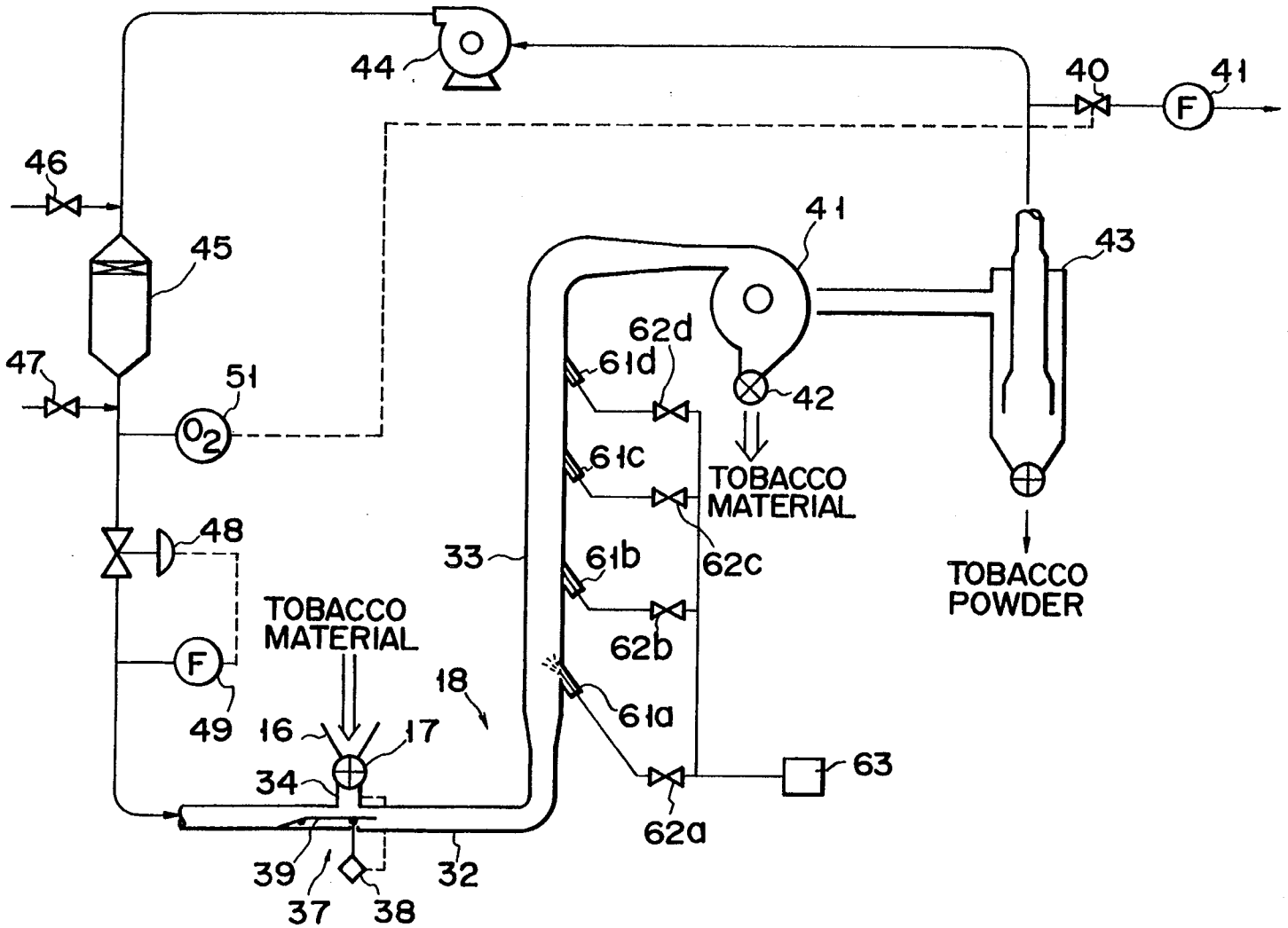
FIG. 2 shows a schematic drawing of the embodiment of a gas-flow drying system for heating the tobacco impregnated with the expanding agent of the present invention with high-temperature gas-flow.

The following is the description of a gas-flow drying system for tobacco in the tobacco system according to FIG. 2. In FIG. 2, numeral 18 is a gas-flow drying pipe which is filled with superheated steam such as steam of 200° to 350° C. made by mixing with 50 to 95 volume percent of air.

A feed port 34 to which tobacco is fed is formed on the gas-flow drying pipe 18. The tobacco impregnated with a expanding agent such as carbon dioxide in the carbon dioxide impregnating process is fed to the feed port 34 through the chute 16 and rotary valve 17.

A static-pressure adjusting system 37 is installed near the feed port 34. The static-pressure adjusting system 37 has a static-pressure sensor 38 for detecting the static pressure in the gas-flow drying pipe 18 close to the feed port 34 and a static-pressure adjusting damper 39 installed at the upstream side of the feed port 34.

The static-pressure adjusting damper 39 is controlled by the signal sent from the static-pressure sensor 38 to adjust the pressure drop of the steam flow passing through the damper 39 so that the static pressure near the feed port 34 is approximately equal to the pressure at the feed side of the rotary valve 17. Thus, it is possible to prevent high-temperature steam from entering the tobacco impregnating system from the rotary valve 17.

The tobacco fed from the feed port 34 is dispersed in the steam flow passing through the feed port 34, and carried while it is heated, expanded, and dried. Then, the expanded and dried tobacco is separated from the steam flow by the tangential separator 41 and the separated tobacco is sent to the next process through a rotary valve 42.

Moreover, tobacco powder contained in the steam separated from the tobacco by the tangential separator 41 is removed from the steam by a cyclone separator 43 and the steam is sent to a heater 45 by a circulation fan 44 and heated by the heater 45. The steam heated by the heater 45 is returned to the tobacco carrying pipe 18 through a circulation flow rate control valve 48 and then circulates through the system. Numeral 49 is a flow rate sensor.

Steam or water is fed to the circulation system before and after the heater through steam feed valves 46 and 47. Meanwhile, a small amount of the steam circulating through the system is exhausted from the system by the exhaust fan 41 through an exhaust control valve 40 at the upstream side of the circulation fan 44. An oxygen concentration sensor 51 is installed at the downstream side of the heater 45 to detect the oxygen concentration or the air content in the steam circulating through the system. The exhaust control valve 40 is controlled corresponding to the oxygen concentration signal to keep the steam content of the mixture gas of the steam and air circulating through the circulation system at a certain rate within the range of 50 to 95 volume percent.

The gas-flow drying pipe 18 consists of an acceleration section 32 and a deceleration section 33 connected to the downstream side of the acceleration section 32. The acceleration section 32 has, for example, the inside diameter of 130 mm and the length of approx. 7 m. The deceleration section 33 has, for example, the inside diameter of 190 mm which is larger than that of the acceleration section 32 and the length of approx. 15 m. Each inside diameter of the acceleration section 32 and deceleration section 33 is not limited to the above-mentioned value. In other words, these inside diameters may be optically set. Steam flows through the acceleration section 32 at the velocity of approx. 50 m/s and through the deceleration section 33 at the velocity of 25 m/s.

A plurality of injection nozzles (e.g. 4 nozzles) are installed on the deceleration section 33. The first injection nozzle 61*a* of these nozzles is installed at the position approx. 2 m downstream from the upstream end of the deceleration section 33. Similarly, the second injection nozzle 61*b*, third injection nozzle 61*c*, and fourth injection nozzle 61*d* are installed in order along the longitudinal direction of the deceleration section 33 every 3 m.

The injection nozzles 61*a* to 61*d* are connected to the injection pipe 63 through injection control valves 62*a* to 62*d* respectively. Steam or water is fed to the injection nozzles 61*a* to 61*d* through the injection pipe 63 and the injection control valves 62*a* to 62*d* from a feed source (not illustrated). The fed steam or water is injected into the steam circulating through the deceleration section 33 from the injection nozzles 61*a* to 61*d*.

The flow rate of the steam or water jetted from the injection nozzles 61*a* to 61*d* is controlled by the injection control valves 62*a* to 62*d*, and the steam or water can selectively be jetted from the injection nozzles 61*a* to 61*d*.

The following is the description of the embodiment of the method of the present invention executed by the above system and the operation of the system.

Tobacco impregnated with a expanding agent such as carbon dioxide is fed into the gas-flow drying pipe 18 from the feed port 34. The fed tobacco is dispersed in the steam flow and accelerated almost up to the flow velocity of the steam in the acceleration section 32. In this case, because a difference occurs between the velocity of the tobacco and that of the ambient steam and the steam has larger specific heat than air, the tobacco is quickly heated and the carbon dioxide contained in the texture of tobacco leaves is quickly expanding to expand the texture of tobacco leaves. Expanding of them almost ends in the acceleration section 32.

The velocity of the expanding tobacco becomes almost equal to that of the steam flow and flows into the deceleration section 33 together with the steam. Because the deceleration section 33 has larger inside diameter than the acceleration section 32, the flow velocity of the steam is decreased. Therefore, the amount of tobacco cut in the deceleration section 33 is minimized. To smoothly carry tobacco, the flow velocity of 15 m/s or more is necessary. Therefore, the flow velocity in the deceleration section 33 is kept at 15 m/s or more. And, more heat is given to the tobacco from the ambient water vapor while it is carried through the deceleration section 33 and dried up to the almost absolute dry condition with the water content of 2 to 3 weight percent. By the drying, the texture of tobacco leaves is solidified and kept under the expanded state.

Because more heat is given to the tobacco from the ambient steam while it is carried through the deceleration section 33, its quality may be degraded. To prevent the above trouble, the present invention jets steam or water from the injection nozzles 61*a* to 61*b* to lower the temperature of the steam flowing through the deceleration section 33. Therefore, it is possible to dry the tobacco without degrading the aroma of the tobacco and its smoking taste.

By injecting water or steam from the injection nozzles 61*a* to 61*d*, the temperature of the steam decreases at the portion downstream from the injection portion. The tobacco passes through the deceleration section 33 at the velocity of approx. 25 m/s as mentioned above. Therefore, it is possible to finely control the tobacco temperature in a short time while it passes through the deceleration section 33. As described above, the quality of the tobacco fed into high-temperature steam is delicately degraded in a very short time. However, according to the above method and system, it is possible to finely and securely control the tobacco temperature. Therefore, the tobacco can be treated under the best condition.

In addition, because tobacco is an agricultural product, the quality varies and the characteristics differs in types of tobacco. Therefore, it is necessary to finely change the treatment condition in the gas-flow drying process according to the variation and difference. In this case, to the above method and system make it possible to precisely and securely control the treatment condition according to the variation of tobacco quality and the difference between types of tobacco and treat the tobacco under the best condition by properly selecting the flow rate of water or water vapor to be injected from the injection nozzles 61*a* to 61*d* and injection portions.

The following is the result of the comparison test between the method of the present invention and the conventional method by using the system shown in FIG. 1. The test is executed by setting the flow rate of tobacco to 100 kg/hr, the ratio of tobacco to circulating steam to about 15 weight percent, and the ratio of air to steam to 80 volume percent. Table 1 shows the result of evaluation on the expanding property and the aroma and smoking taste of the treated tobacco for the cases in which water or steam is not injected into the deceleration section 33 as ever and it is injected as the present invention.

TABLE 1

| Test No. | Injected or not injected | Injection portion and flow rate [kg/hr] | Heating temperature [C°] | Entrance temperature or deceleration section [C°] | Entrance temperature of ty tangential separator | Filling Capaci- of (pieces/ kg) | Evaluation no aroma and smoking taste (marks) |
|---|---|---|---|---|---|---|---|
| 1 | Not Injected | | 300 | 221 | 181 | 2681 | −3.0 |
| 2 | Injected | 61a Water 30 | 300 | 221 | 162 | 2679 | −0.5 |
| 3 | " | a Water 20<br>c Water 15 | 300 | 221 | 158 | 2667 | +2.5 |
| 4 | Not Injected | | 320 | 234 | 193 | 2749 | −3/0 |
| 5 | Injected | 61a Water 20<br>c Water 20 | 320 | 234 | 155 | 2705 | +2.0 |

Table 2 shows the criteria for evaluation on aroma and smoking taste. This evaluation is executed by a panel of ten experts of panel.

TABLE 2

| Marks | Criteria |
|---|---|
| −3: | The tobacco cannot be used at all because of very strong burnt aroma and rough taste. |
| −2: | The tobacco cannot be used because of strong burnt aroma and rough taste. |
| −1: | It should be avoided to use the tobacco because of burnt aroma and rough taste. |
| 0: | Though the tobacco can be used because of no burnt aroma or rough taste, it is better to avoid using it. |
| +1: | The tobacco can be used because of no burnt aroma or rough taste. |
| +2: | There is no problem in using the tobacco because it is free from burnt aroma and rough taste and the aroma and smoking taste are balanced. |
| +3: | The tobacco can unconditionally be used because it does not have burnt aroma or rough taste at all and the aroma and smoking taste are great. |

As shown in Table 1, it is evaluated that the aroma and smoking taste are adequate for practical use for the method of the present invention, that is, when water is jetted from the injection nozzles. Though the filling capacity is slightly degraded for the method of the present invention, it is a high enough value for practical use. In general, expanded tobacco is enough for practical use if the filling capacity of approx. 2,600 pieces/kg or more is obtained.

Table 3 shows the result of the same test as the above when the mixture ratio of tobacco to water vapor is increased up to about 20 weight percent.

However, if the mixture ratio is increased up to about 30 weight percent which is approx., unevenness occurs in the filling capacity of treated tobacco and troubles occur in the quality.

TABLE 3

| Test No. | Injected or not injected | Injection portion and flow rate [kg/hr] | Heating temperature [C°] | Entrance temperature or deceleration section [C°] | Entrance temperature of tangential separator | Filling Capaci- of (pieces/ kg) | Evaluation no aroma and smoking taste (marks) |
|---|---|---|---|---|---|---|---|
| 1 | Not Injected | | 280 | 195 | 154 | 2558 | +1.5 |
| 2 | Injected | 61a Water 5 | 280 | 195 | 149 | 2552 | +2.0 |
| 3 | Not Injected | | 320 | 216 | 170 | 2664 | −2.5 |
| 4 | Injected | 61b Water 25 | 320 | 216 | 151 | 2656 | +2.0 |

Also in this case, the result of evaluation on the aroma and smoking taste is enough for practical use and it is concluded that the filling capacity is the same as that of the conventional method.

Figure 3:
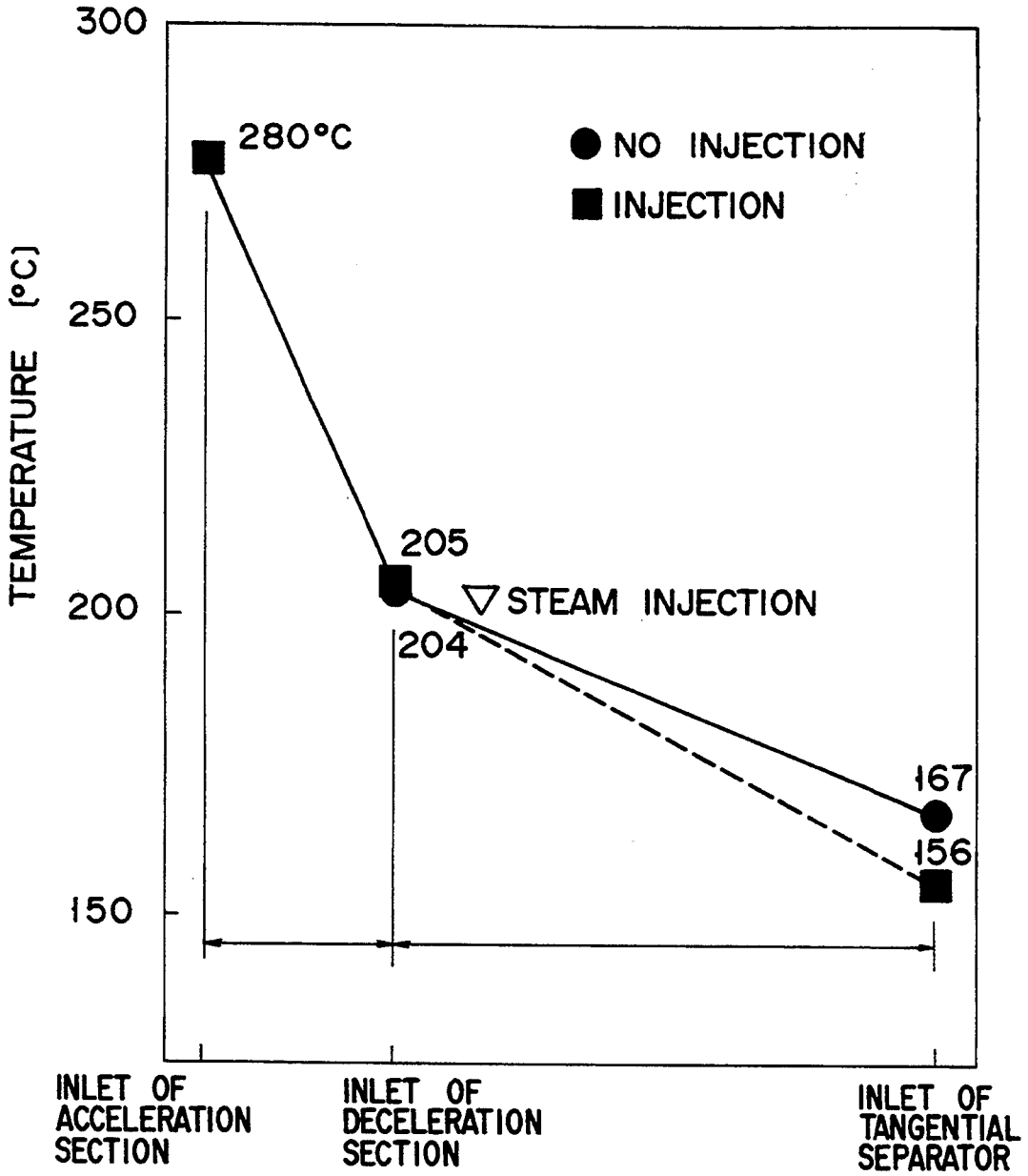
FIG. 3 is a diagram showing the temperature change in the gas-flow drying pipe shown in FIG. 2.

FIG. 3 shows the result of actually measuring the temperature in the gas-flow drying pipe 18 for the cases in which the conventional method is executed and the method of the present invention in which steam is injected from the injection nozzles is executed, using the system of the embodiment of the present invention. From FIG. 3, it is found that the temperature in the deceleration section 33 decreases when the method of the present invention is executed.

The present invention is not restricted to the above embodiment. For example, it is possible to inject low-temperature steam from the injection nozzles instead of water.

As mentioned above, the method of the present invention makes it possible to finely and accurately control the temperature of the tobacco fed into steam flow and treat the tobacco under the best condition so that adequate filling capacity of the tobacco and high evaluation on the aroma and smoking taste of it can be obtained.

Moreover, the system of the present invention makes it possible to finely and precisely control the temperature of steam and tobacco flowing through a structure consisting of only a gas-flow drying pipe and injection nozzles.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method for impregnating tobacco with an expanding agent before heating the tobacco to expand the expanding agent and thereby, expand the tobacco, comprising the steps of:

impregnating tobacco with the expanding agent;

feeding the tobacco impregnated with the expanding agent into steam or high-temperature gas containing steam, and flowing the tobacco together with the gas;

injecting steam or water into the gas flow at a position in said gas flow downstream from said tobacco feed position;

lowering the temperature of said gas by the step of injecting steam or water; and controlling the heat quantity to be given to the tobacco from the gas at the position where steam or water is injected to prevent degradation of the tobacco and to lower water content of the tobacco.

2. The method according to claim 1, wherein said steam or water is jetted to a position where the tobacco fed into said gas flow ends expanding while flowing together with the gas and before drying of the tobacco is completed.

3. The method according to claim 1, wherein said steam or water is injected into said gas flow from a plurality of positions.

4. A method according to claim 1, wherein said expanding agent is made of carbon dioxide.

5. The method according to claim 1, wherein the step of injecting steam or water occurs at a plurality of positions in said gas flow downstream from said tobacco feed position and wherein the method further comprises the step of changing velocity of the gas flow downstream from said tobacco feed position.

6. The method according to claim 5, wherein the step of feeding and flowing the tobacco comprises the step of passing the tobacco through a gas-flow drying pipe having an acceleration section and a deceleration section, the velocity of the gas flow decreasing between the acceleration section and the deceleration section during the step of changing velocity.

7. The method according to claim 6, wherein the deceleration section has a larger inside diameter than the acceleration section and wherein the step of changing velocity occurs as the gas flow and tobacco move from the acceleration section to the deceleration section.

8. The method according to claim 7, wherein the gas flow has a velocity of about 50 m/s in the acceleration section and a velocity of 25 m/s in the deceleration section, and wherein four nozzles are provided in the deceleration section for injecting steam or water into the gas flow during the step of injecting.

9. The method according to claim 1, further comprising the step of heating the tobacco during the step of feeding the tobacco into the gas flow, the heating occurring because of a difference in velocity of the tobacco and the gas flow and because the gas flow has a larger specific heat than the tobacco, the heating of the tobacco causing expanding of the expanding agent.

10. The method according to claim 1, wherein the step of controlling lowers the water content of the tobacco to 2 to 3 percent by weight.

11. A system for impregnating tobacco with an expanding agent before heating the tobacco to expand the expanding agent and thereby, expand said tobacco, comprising:

impregnating means for impregnating tobacco with the expanding agent;

a gas-flow drying pipe through which steam or high-temperature gas containing steam flows;

a feed port installed on the gas-flow drying pipe, which feeds the tobacco impregnated with said expanding agent by said impregnating means into said high-temperature gas flowing through the gas-flow drying pipe;

injection nozzles installed on said gas-flow drying pipe at a position of said high-temperature gas flow downstream from said feed port, which inject steam or water into high temperature gas flowing through said gas-flow drying pipe in order to lower the temperature of the gas;

control means for controlling the heat quantity to be given to the tobacco by the gas by controlling steam or water injected by the injection nozzles, the control means preventing degradation of the tobacco and lowering water content of the tobacco, the control means includes a valve for each injection nozzle; and means for changing velocity of the gas flowing in the gas-flow drying pipe, said means for changing velocity comprises means forming an acceleration section and means forming a deceleration section, said means forming an acceleration section increasing the velocity for said high-temperature gas flowing through the gas-flow drying pipe and said means forming a deceleration section decreasing the velocity of gas flowing through the gas-flow drying pipe, said injection nozzles being installed on the deceleration section.

12. The system according to claim 11, wherein a plurality of said injection nozzles are arranged along the direction of the high-temperature gas flowing through said gas-flow drying pipe.

13. The system according to claim 11, wherein the means for changing velocity comprises the deceleration section having a larger inside diameter than the acceleration section such that velocity of the gas flow is less in the deceleration section than in the acceleration section.

14. The system according to claim 13, wherein the plurality of injection nozzles are provided in the deceleration section, the nozzles being generally uniformly spaced longitudinally along the deceleration section.

15. The system according to claim 14, wherein four nozzles are provided as the plurality of injection nozzles.

16. The system according to claim 11, wherein the control means lowers the water content of the tobacco to 2 to 3 percent by weight.

* * * * *